United States Patent [19]

Bridger et al.

[11] 4,123,372

[45] Oct. 31, 1978

[54] LUBRICANT COMPOSITIONS CONTAINING ANTIOXIDANTS

[75] Inventors: Robert F. Bridger, Hopewell; Phillip S. Landis, Woodbury, both of N.J.

[73] Assignee: Mobil Oil Corporation, New York, N.Y.

[21] Appl. No.: 729,570

[22] Filed: Oct. 4, 1976

[51] Int. Cl.[2] ..... C10M 1/38; C10M 3/32; C10M 5/22

[52] U.S. Cl. ..... 252/48.2; 252/47; 252/47.5; 252/402

[58] Field of Search ..... 252/47, 47.5, 402

[56] References Cited

U.S. PATENT DOCUMENTS

| | | | |
|---|---|---|---|
| 2,467,713 | 4/1949 | Watkins | 252/47 X |
| 2,718,501 | 9/1955 | Harle | 252/47 |
| 3,345,292 | 10/1967 | Neale et al. | 252/48.2 X |
| 3,481,871 | 12/1969 | Myers et al. | 252/48.2 X |
| 3,697,499 | 10/1972 | Myers | 252/48.8 X |
| 3,925,414 | 12/1975 | Landis et al. | 252/45 X |
| 4,031,018 | 6/1977 | Murphy | 252/47.5 |

*Primary Examiner*—Delbert E. Gantz

*Assistant Examiner*—Andrew H. Metz

*Attorney, Agent, or Firm*—Charles A. Huggett; Raymond W. Barclay; Howard M. Flournoy

[57] ABSTRACT

Compositions of improved antioxidant characteristics are provided comprising organic media, normally susceptible to oxidation, e.g., oils of lubricant viscosity and greases prepared therefrom containing a minor amount sufficient to impart antioxidant properties thereto of an admixture of a polydisulfide having at least one unit therein with the following structure:

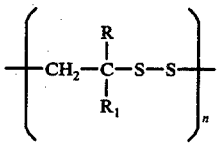

where $n$ is from 2 to about 20 and R and $R_1$ are hydrogen or $C_1$–$C_{10}$ alkyl; and a compound selected from the group consisting of arylamines and hindered phenols.

14 Claims, No Drawings

LUBRICANT COMPOSITIONS CONTAINING ANTIOXIDANTS

BACKGROUND OF THE INVENTION

1. Field of the Invention

This application is directed to compositions of improved antioxidant characteristics comprising organic media susceptible to oxidation, such as oils and greases of lubricating viscosity, fuel oils, plastics, synthetic rubbers and the like which contain, in an amount sufficient to impart antioxidant properties thereto, a mixture of certain polydisulfides, and arylamines or hindered phenols.

2. Description of Prior Art

It is known to use mixtures of sulfur containing compounds, e.g., diesters of thiodicarboxylic acids and hindered phenols to stabilize organic polymers against exposure to light and air; U.S. Pat. Nos. 3,644,282 and 3,652,495. It is also known to use arylamines such as phenyl naphthylamines as antioxidants for lubricating oils and for various polymers; U.S. Pat. Nos. 3,649,690, 3,781,361. Polydisulfides of the type contemplated herein are obtained, for example, by reacting isobutylene and a sulfur halide, etc., as disclosed in U.S. Pat. Nos. 3,873,454 and 3,925,414; being useful as extreme pressure and antiwear additives for lubricant compositions.

SUMMARY OF THE INVENTION

This application, however, is directed to the discovery that compositions of improved antioxidant characteristics are provided when a mixture of certain polydisulfies which are soluble in the above described organic media and arylamines or hindered phenols are added thereto in appropriate amounts.

This application is more particularly directed to lubricant compositions comprising a major proportion of an oil of lubricating viscosity, and greases prepared therefrom, containing a minor proportion sufficient to impart antioxidant properties thereto of a mixture comprising a polydisulfide having at least one unit therein with the following general structure:

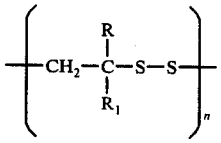

where $n$ is from 2 to about 20 and R and $R_1$ are hydrogen or $C_1$–$C_{10}$ alkyl; and a compound selected from the group consisting of arylamines and hindered phenols.

DESCRIPTION OF SPECIFIC EMBODIMENTS

The arylamines used herein are preferably selected from the group consisting of the following: N-phenyl-1-naphthylamine; N-phenyl-2-naphthylamines; 4,4'-thiobis[N-phenyl-1-naphthylamine]; 1,1'-thiobis[N-phenyl-2-naphthylamine]; diphenylamine, dinaphthylamine and phenothiazine. Especially preferred are phenyl napthylamines such as N-phenyl-1-naphthylamine and N-phenyl-2-naphthylamine. However, it is understood that this is a non-limiting list and any arylamine appropriate in view of those disclosed above may be used.

Any suitable hindered phenolic compound may be used herein. Preferred are those selected from the following non-exhaustive list 2,6-di-t-butyl-p-cresol; 2,2'-methylenebis(2,6-di-t-butyl-p-cresol) 2,2'-methylenebis(2-6-di-t-butyl-m-cresol); 4,4'-butylidenebis(6-t-butyl-p-cresol) 4,4'-methylenebis(2,6-di-t-butyl-phenol); 2,6-di-t-butylphenol and 4,4'-butylidenebis(6-t-butyl-m-phenol) 2,4,6-tri-t-butylphenol. Especially preferred is 4,4'-methylenebis(2,6-di-t-butylphenol).

In general, the polydisulfides embodied in the invention comprise a compound having at least one structural unit therein defined as follows:

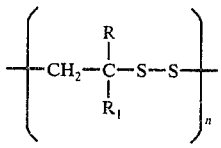

where $n$ is from 2 to about 20 and preferably is in the range of from about 4 to about 10 and R and $R_1$ are hydrogen of $C_1$–$C_{10}$ alkyl.

The process of making the polydisulfides utilized in the invention form no part hereof; said process may be conveniently carried out in accordance with U.S. Pat. Nos. 3,925,414 and 3,697,499.

In general, the polysulfides can be obtained by reacting a $C_2$–$C_{12}$ olefin, preferably $C_4$–$C_8$, e.g., isobutylene, a sulfur monohalide, e.g., sulfur chloride, to produce an adduct; and then (1) reacting the adduct so produced with an alkali metal mercaptide, e.g., sodium mercaptide, in a non reactive liquid medium such as methanol, ethanol, propanol and the like; or (2) reacting the adduct produced with an alkali metal sulfide, e.g., sodium sulfide and free sulfur, and then reacting the product thereof with an inorganic base, e.g., alkali metal base such as sodium hydroxide. The step described above labelled (1) results in a substantially cyclic product as described in U.S. Pat. No. 3,925,414 and the step labelled (2) results in a substantially open chain product as described in U.S. Pat. No. 3,697,499. Other synthetic methods can be used to prepare the polydisulfides such as the reaction of methalkyldisulfide with NaSH or the reaction of the Bunte' salt of methalkyl mercaptan with NaSH.

The polydisulfides in accordance with this invention are then admixed with either a hindered phenolic compound or an arylamine to obtain a synergistic mixture of improved antioxidant properties. The weight ratio of polydisulfide to amine or phenol in said admixtures is usually from about 0.75–2.5 to 1 of polydisulfide to amine or phenol. Preferred is a weight ratio of 1–2 to 1 or substantially equimolar ratios.

The antioxidant additive mixtures embodied herein are effective in the standard conventional amounts usually used, that is, the mixture comprises from about 0.01 to about 5% by weight of the total composition; the lubricant, plastic composition, fuel oil, rubber, etc., comprising the remainder of the composition along with any other additives normally used in such compositions, such as in the case of lubricants extreme pressure agents, viscosity control agents detergents and the like.

This application in its preferred embodiments is directed to lubricant compositions comprising a major amount of an oil of lubricating viscosity, and greases prepared therefrom and a minor amount sufficient to improve the antioxidant properties of the aforementioned lubricant compositions of the hereindescribed antioxidant additives.

The lubricant compositions hereof may comprise any materials that normally exhibit insufficient antioxidant properties. Especailly suitable for use with the additives of this invention are liquid hydrocarbon oils boiling within the range from about 75° F. to about 1,000° F. Lubricant oils, improved in accordance with the present invention, may be of any suitable lubricating viscosity, ranging from about 45 SSU at 100° F. to about 6,000 SSU at 100° F. and, preferably, from about 50 to 250 SSU at 210° F. Oils having viscosity indexes from about 70 to about 95 at 210° F. are preferred. The average molecular weight of these oils ranges from about 250 to about 800. In general, the lubricant compositions may comprise any mineral or synthetic oil of lubricating viscosity.

In instances where synthetic oils are desired in preference to mineral oils they may be employed alone or in combination with a mineral oil. They may also be used as the vehicle or base for grease compositions. Typical synthetic lubricants include polyisobutylene, polybutenes, hydrogenated polydecenes, polyproplyene glycol, polyethylene glycol, trimethylol propane esters, neopentyl and pentaerythritol esters, di(2-ethyl hexyl) sebacate, di(2-ethyl hexyl) adipate, dibutyl phthalate, fluorocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-subtituted diphenyl ethers typified by a butyl-substituted bis(p-phenoxy phenyl) ether, phenoxy phenylethers, dialkylbenzenes etc.

As hereinbefore indicated, the aforementioned additives can be incorporated as antioxidation agents in grease compositions. When high temperature stability is not a requirement of the finished grease, mineral oils having a viscosity of at least 40 SSU at 150° F., and particularly those falling within the range of from about 60 SSU to about 6,000 SSU at 100° F. may be employed. The lubricating compositions of the improved greases of the present invention, containing the above-described additives, are combined with a grease-forming quantity of a thickening agent. For this purpose, a wide variety of materials can be dispersed in the lubricating oil in grease-forming quantities in such degree as to impart to the resulting grease composition the desired consistency. Exemplary of the thickening agents that may be employed in the grease formulation are non-soap thickeners, such as surface-modified clays and silicas, aryl ureas, calcium complexes and similar materials. In general, grease thickeners are employed which do not melt or dissolve when used at the required temperature within a particular environment; however, in all other respects, any material which is normally employed for thickening or gelling oleaginous fluids or forming greases may be used in the present invention.

The following examples are intended to exemplify the hereinembodied invention and in no way limit the scope thereof.

EXAMPLE I

Sulfur monochloride (1013g. 75 moles) was charged into a 3-L. (liter) 4-necked reaction flask equipped with a mechanical stirrer, condenser (drying tube attached) a thermometer, and a sub-surface gas sparger. While keeping the temperature between 45°–50° C., isobutylene was passed over 60g of methanol in the reaction flask over an 8-period, during which 716g (12.8 moles) of isobutylene were consumed. The reaction mixture was then purged at 40° C. with a stream of nitrogen for 30 minutes and then filtered to yield 1579g of a light amber liquid.

Sodium mercaptide, (1200g) and 1250 ml of ethanol were charged into a 5-L. reaction flask fitted with a stirrer, condenser, (drying tube attached) thermometer and an addition funnel. After stirring to get a good dispersion of the solids, 620g of the above, isobutylene-sulfur monochloride adduct was added carefully at first from the addition funnel until a temperature of 45° C. was attained and then the addition was continued dropwise. The addition took about 2 hours. By carefully regulating the addition, the temperature was kept at close to 40° C., and excessive foaming ($H_2S$ evolution) was avoided.

Following the aforementioned addition, the reaction mixture was heated, while stirring at 45°–50° C. for an additional 3 hours. After cooling to room temperature, it was filtered, the solids washed with hexane, with water and ether; and a water insoluble white solid product was collected. The filtrate was allowed to stay overnight under house vacuum. The solid product which precipitated from the filtrate was collected and washed several times with water and ether and dried. The combined solids were further purified by stirring vigorously in water and a little ether, collected and dried to yield 250g of white solid product, having a sulfur content of 53 percent. This product was found to have the following structure:

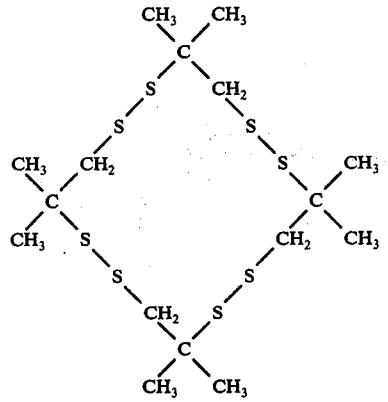

EXAMPLE II

Into a 5-liter reaction flask 2025 grams (15.0 moles of sulfur monochloride) were added and the contents were heated to 45° C. Through a sub-surface gas sparger, 1468 grams (26.2 moles of isobutylene gas) were fed into the reactor over a 5-hour period. The temperature was maintained between 45° and 50° C. At the end of the sparging, the reaction flask has an increase in weight of 1,352 grams. Into a 12-liter reaction flask were added 2,150 grams (16.5 moles) of 60 percent flake sodium sulfide, 240 grams (7.5 moles) sulfur, and a solution of 420 ml of isopropanol in 4,000 ml of water. The contents were heated to 40° C. The adduct of the sulfur monochloride and isobutylene previously prepared was added over a ¾-hour period while permitting the temperature to rise to 75° C. The reaction mixture was refluxed for 6 hours, and afterward the mixture was permitted to form into separate layers. The lower aqueous layer was discarded. The upper organic layer was mixed with 2 liters of 10 percent aqueous sodium hydroxide and the mixture was refluxed for 6 hours. The organic layer was again removed and washed with 1 liter of water. The washed product was dried by heating at 90° C. and 30 mm Hg pressure for 30 minutes. The residue was filtered through diatomaceous earth filter aid to give 2,070 grams of a clear yellow-orange liquid.

The analysis of this product was as follows:

| | |
|---|---|
| % Carbon | 45.71 |
| % Hydrogen | 7.61 |
| % Sulfur | 46.6 |

The product was found to contain the open chain variation of the structure hereinbefore described.

EXAMPLE III

The process of Example II was repeated except that the final product analyzed as followed:

| | |
|---|---|
| % Carbon | 46.30 |
| % Hydrogen | 7.51 |
| % Sulfur | 46.10 |

EXAMPLES IV & V

Example IV, N-phenyl-1-naphthylamines was obtained from commercial sources. Example V, 4,4'-methylene-bis(2,6-di-t-butylphenol) was also commercially obtained.

Oxygen absorption experiments were carried out in the Dornte[1] apparatus modified so the rate of oxygen absorption could be recorded automatically; n-hexadecane[2] was used as solvent with an oxygen circulation rate of 5 liters per hours; temperature 175° C., and sample weight 30 grams.

1. R. F. Bridger, A. L. Williams and L. J. McCabe, *Ind. Eng. Chem. Prod. Res. Dev.*, 5 226 (1966) and R. W. Dornte, Ind. Eng. Chem. 28, 26 (1936).
2. N-hexadecane is a colorless liquid derived from a mineral oil base with a b.p. of 286.5° C.; m.p. of 18.14° C. and a sp.gr. of 0.77335 (20/4° C.).

The 30 gram sample was placed in the modified Dornte circulatory system and allowed to equilibrate thermally while said oxygen flow of 5 liters per hours was begun. Oxygen was introduced to the sample at the 5 liters per hour rate through a fritted glass disk 3 mm from the bottom of a tube whereby the sample had been introduced into the apparatus. The inhibition or induction period, $T_{1.0}$(hours) was taken at the time required for the absorption of one mole of oxygen per kg of oil. The results are shown in Table I. Note that Examples II and III were not compared at equivalent molar concentrations at 0.1% wt. alone and at 0.05% weight in combination with N-phenyl-1-naphthylamine because they are not pure compounds.

The test mixtures, that is, the combination of Examples I and IV, I and V, II and IV, and III and IV exhibit strong synergism showing much improved oxidation inhibition in hexadecane over any of the additives alone.

Table II shows the effect of two well-known disulfides, benzyldisulfide and phenyldisulfide under identical test conditions as in the Table I oxygen absorption experiment. No appreciable synergism was observed between these "conventional" disulfides and N-phenyl-1-naphthylamine.

Thus, the data of Table I clearly shows the strong synergism between the polydisulfides and the arylamines and hindered phenols as disclosed herein whereby lubricant compositions of improved antioxidant properties are provided. The data of Table II clearly shows conventional disulfides outside the scope of this invention are not strongly synergistic when admixed with arylamines or hindered phenols.

The description and disclosure of the preferred embodiments of this invention are not to be construed as limitations of the invention.

TABLE I

Inhibition of Autoxidation of Hexadecane[a]

| Additive | Conc. Wt. % | Conc. Mol/kg | $t_{1.0}$(hr.) |
|---|---|---|---|
| NONE | — | — | 1.1 |
| Example I | 0.21 | 0.005 | 2.2 |
| Example IV | 0.11 | 0.005 | 6.3 |
| Example IV | 0.11 | 0.005 | 5.8 |
| Example IV | 0.06 | 0.0025 | 30.3 |
| Example I | 0.11 | 0.0025 | |
| Example V | 0.24 | 0.005 | 7.2 |
| Example V | 0.12 | 0.0025 | 20.3 |
| Example I | 0.11 | 0.0025 | |
| Example II | 0.10 | — | 2.0 |
| Example III | 0.10 | — | 2.9 |
| Example II | 0.05 | — | 43.6 |
| Example IV | 0.05 | — | |
| Example III | 0.05 | — | 33.2 |
| Example IV | 0.05 | — | |

[a]Temperature about 175° C.

TABLE II

EFFECT OF OTHER DISULFIDES ON INHIBITION OF AUTOXIDATION OF HEXADECANE[a]

| ADDITIVE | Conc. Wt. % | Conc. Mol./kg | $t_{1.0}$ (hr.) |
|---|---|---|---|
| NONE | — | — | 1.2 |
| NONE | — | — | 1.1 |
| Example IV | 0.11 | 0.005 | 6.3 |
| Example IV | 0.11 | 0.005 | 5.8 |
| Benzyldisulfide | 0.11 | 0.005 | 3.0 |
| Phenyldisulfide | 0.11 | 0.005 | 2.4 |
| Benzyldisulfide | 0.055 | 0.0025 | 11.1 |
| Example IV | 0.055 | 0.0025 | |
| Phenyldisulfide | 0.055 | 0.0025 | 4.6 |
| Example IV | 0.055 | 0.0025 | |

[a]Temperature about 175° C

What is claimed is:

1. A composition comprising a major proportion of an organic medium normally susceptible to oxidation wherein the organic medium is selected from the group consisting of oils of lubricating viscosity and greases prepared therefrom, and a minor proportion sufficient to impart antioxidant properties thereto of a mixture soluble therein comprising a polydisulfide having at least one unit therein with the following general structure:

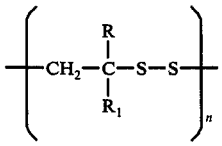

where $n$ is from 2 to about 20 and R and $R_1$ are hydrogen or $C_1$–$C_{10}$ alkyl; and a compound selected from the group consisting of arylamines and hindered phenols wherein the arylamine is selected from N-phenyl-1-naphthylamine; N-phenyl-2-naphthylamine; 4,4'-thiobis[N-phenyl-1-naphthylamine]; 1,1'-thiobis[N-phenyl-2-naphthylamine]; diphenylamine, dinaphthylamine and phenothiazine and wherein the hindered phenol is selected from 2,6-di-t-butyl-p-cresol; 2,2'-methylenebis(2,6-di-t-butyl-p-cresol) 2,2'-methylenebis(2,6-t-butyl-m-cresol; 4,4'-butylidine-bis(6-t-butyl-m-cresol); 4,4'-methylenebis(2,6-di-t-butylphenol); 2,6-di-t-butyl-p-phenol and 4,4'-butylidinebis(6-t-butylphenol).

2. The composition of claim 1 wherein the hindered phenol is 4,4'-methylenebis(2,6-di-t-butylphenol).

3. The composition of claim 1 wherein $n$ is from about 4 to about 10.

4. The composition of claim 1 wherein said sulfide is produced by reacting sulfur monochloride with a stoichiometric excess of a $C_2$–$C_{12}$ olefin, treating the resulting produce with an alkali metal sulfide in the presence of free sulfur in an alcohol-water solvent and reacting that product with an inorganic base.

5. The composition of claim 4 wherein said olefin is a $C_4$–$C_8$ olefin.

6. The composition of claim 4 wherein the alkali metal sulfide is sodium sulfide and the alcohol is selected from methanol, ethanol, propanol, isopropanol and butanol.

7. The composition of claim 4 wherein the inorganic base is selected from alkali metal hydroxide, alkali metal carbonate and ammonia.

8. The composition of claim 7 wherein the alkali metal is sodium.

9. The composition of claim 1 wherein the weight ratio of disulfide to amine or phenol is from about 1–2 to 1.

10. The composition of claim 1 wherein the oil of lubricant viscosity is a mineral oil.

11. The composition of claim 1 wherein the oil of lubricant viscosity is a synthetic oil.

12. The composition of claim 1 wherein the lubricant composition is a grease.

13. The composition of claim 1 where R and $R_1$ are both $CH_3$.

14. The composition of claim 1 wherein the arylamine is N-phenyl-1-naphthylamine.

* * * * *

UNITED STATES PATENT AND TRADEMARK OFFICE

CERTIFICATE OF CORRECTION

PATENT NO. : 4,123,372

DATED : October 31, 1978

INVENTOR(S) : ROBERT F. BRIDGER and PHILLIP S. LANDIS

It is certified that error appears in the above-identified patent and that said Letters Patent are hereby corrected as shown below:

Column 4, line 1, "an 8-period", should read --an 8-hour period--.

Column 7, line 23, "resulting produce", should read --resulting product--.

Signed and Sealed this

Sixth Day of March 1979

[SEAL]

*Attest:*

RUTH C. MASON
*Attesting Officer*

DONALD W. BANNER
*Commissioner of Patents and Trademarks*